United States Patent [19]

Farng et al.

[11] Patent Number: 4,715,974

[45] Date of Patent: Dec. 29, 1987

[54] COPPER SALTS OF SULFURIZED FATTY ACIDS AS ANTIOXIDANTS

[75] Inventors: Liehpao O. Farng; Andrew G. Horodysky, both of Cherry Hill, N.J.

[73] Assignee: Mobil Oil Corporation, New York, N.Y.

[21] Appl. No.: 38,080

[22] Filed: Apr. 14, 1987

[51] Int. Cl.[4] ..... C10M 135/34; C10M 153/02

[52] U.S. Cl. ..... 252/46.4; 252/35

[58] Field of Search ..... 252/35, 46.4

[56] References Cited

U.S. PATENT DOCUMENTS

| | | | |
|---|---|---|---|
| 2,349,820 | 5/1944 | Fox | 252/46.4 |
| 2,567,023 | 9/1951 | Morway et al. | 252/35 |
| 2,863,847 | 12/1958 | Morway | 252/35 |
| 2,873,178 | 2/1959 | Biswell | 252/35 |
| 3,132,103 | 5/1964 | Teeter et al. | 252/46.4 |
| 4,664,825 | 5/1987 | Walsh | 252/45 |

*Primary Examiner*—William R. Dixon, Jr.
*Assistant Examiner*—Jerry D. Johnson
*Attorney, Agent, or Firm*—Alexander J. McKillop; Michael G. Gilman; Howard M. Flournoy

[57] ABSTRACT

Sulfurized copper salts of fatty acids provide excellent antioxidation characteristics for lubricants when incorporated into compositions thereof.

22 Claims, No Drawings

COPPER SALTS OF SULFURIZED FATTY ACIDS AS ANTIOXIDANTS

BACKGROUND OF THE INVENTION

This invention is directed to novel copper salts of sulfurized fatty acids and to their use in various organic compositions such as lubricants and other such material normally subject to oxidative degradation, containing a minor amount sufficient to impart antioxidant characteristics thereto of said sulfurized copper salts.

In a more particular aspect this invention is directed to the above referred to novel sulfurized fatty acid salts and lubricant compositions thereof. The lubricating oils are oils of lubricating viscosity as basestocks or hydrocracked lubricating oils or oils of lubricating viscosity adapted for use as hydraulic oils, various automotive oils, transmission fluids, waxes and greases and other solid or liquid forms requiring the presence of stabilizing agents to inhibit oxidative degradation. These oils may be derived from mineral oils or fractions thereof or synthetic oils or as mixtures of mineral and synthetic oils.

The use of sulfur compounds such as thioesters, dithiocarbamates, dithiophosphates, sulfurized fatty esters, and sulfurized olefins, have been well known for their antioxidant properties as well as their antiwear, EP characteristics in a variety of products.

The use of copper carboxylates such as copper oleate has been reportedly used as an antioxidant in European Pat. No. 92946 and in British Pat. No. 2,056,482 as an engine oil antioxidant.

The use of carboxylates as antirust and antirust and anticorrosion additive in lubricants have been well documented and include derivatives of oleic acid and oleoyl sarcosine.

The use of copper thiobis/alkylphenols as antioxidant additives has been described in U.S. Pat. No. 4,225,448.

It has now been found that the use of these new sulfurized fatty acid copper salts provide exceptional multifunctional antioxidant activity, anticorrosion, antiwear, and EP properties. The antioxidant activity demonstrated is greater than that reported for corresponding copper carboxylates or sulfur containing compounds.

These remarkable benefits are also expected for a variety of synthetic and mineral oil based lubricants. To the best of our knowledge, these compositions have not been previously used as antioxidants in lubricating oils, greases, plastics or fuel applications.

None of the foregoing, however, disclose lubricant compositions containing the novel multifunctional sulfurized fatty acid derivatives described in accordance with the present invention.

SUMMARY OF THE INVENTION

As stated hereinabove, it has been found that lubricant compositions containing small additive concentrations of copper salts of sulfurized fatty acids, such as cupric carboxylate salts of sulfurized oleic acid or sulfurized linoleic acid, possess excellent antioxidant activity. Both the copper carboxylate and the sulfur moieties are believed to provide the basis for internal synergistic antioxidant activity. The carboxylate group is also believed to contribute additional antirust properties to the additives. These beneficial properties are believed to be enhanced as a result of this novel internal synergism. This internal synergism concept is also believed to be applicable to similar structures containing both (a) sulfur and (b) copper carboxylate groups within the same molecule. The products of this invention also show good compatibility when used in the lubricant compositions in the presence of other additives.

Generally speaking, compositions in accordance with the invention comprise a major amount of an oil of lubricating viscosity or grease or other solid lubricant prepared therefrom or any suitable organic medium normally subject to oxidative degradation and a minor amount sufficient to impart antioxidant, anticorrosion, antiwear and/or EP characteristics thereto of the herein described sulfurized fatty acid copper salt.

DESCRIPTION OF PREFERRED EMBODIMENTS

In accordance with the invention unsaturated fatty acids acids are reacted with either elemental sulfur and/or hydrogen sulfide to generate sulfurized fatty acids. By fatty acids is meant generally those carboxylic acids which conform to the following generic formulae $C_nH_{2n+1}COOH$ or $C_nH_{2n-1}COOH$, or $C_nH_{2n-3}COOH$ and having from about 8 to about 30 carbon atoms. Preferred are such acids as oleic and linoleic acids. The reaction products include various mixtures of sulfides, polysulfides, dithiol-thiones and sulfurized dimers and oligomers, all of which contain one or more carboxyl groups.

These sulfurized fatty acids are subsequently converted to their corresponding copper salts by reaction with (1) almost molar quantities, (2) less than molar quantities, or (3) more than molar quantities of Cu(I) or Cu(II) ions to make neutral, acidic, or basic salts (Equation 1).

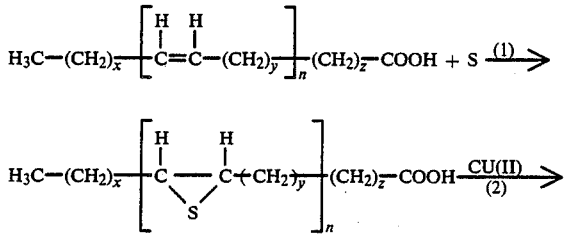

(plus other sulfur-containing products)

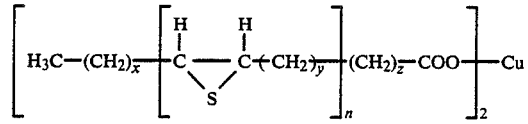

(plus other sulfur-containing copper salts)

where x, z=0–18, n=1–4, y=0–3.

It is to be understood that the above represented sulfur containing intermediate and the sulfur containing copper salt are merely illustrative. The exact nature of the reaction products is not fully known.

Generally, the preferred copper compounds used in this invention are cupric acetate hydrate $[Cu(C_2H_3O_2)_2.H_2O]$, basic cupric acetate $[Cu(C_2H_3O_2)_2CuO.6H_2O]$, cupric carbonate ($CuCO_3$), basic cupric carbonate $[CuCO_3\text{-}Cu(OH)_2]$, cuprous hydroxide (CuOH) and cupric hydroxide $[Cu(OH)_2]$, and other similar copper compounds.

The general reaction conditions may be any suitable conditions known in the art. Usually reaction (1) is preferably carried out at decreasing temperatures of from about 200° to about 90° C. and in molar quantities ranging from 0.10 to substantially molar amounts of sulfur to fatty acid and reaction (2) at temperatures of from about 70° to about 150° C. If a solvent is used the temperature of reaction will vary accordingly. Usually atmospheric or ambient pressure is used, however, higher or lower pressures may be used if desired. The time of reaction will, of course, vary primarily with the temperature and pressure etc. used.

As hereinbefore indicated, the fatty acid sulfur-containing copper salts may be incorporated in various organic media which includes mineral oils of lubricating viscosity and also greases in which any of the oils mentioned herein may be employed as vehicles. In general, synthetic oils can also be effectively used or may also be employed in combination with mineral oils, or as grease vehicles. Typical synthetic vehicles include polyisobutylene, polybutenes, hydrogenated polydecenes, polypropylene glycol, polyethylene glycol, trimethylol propane esters, neopentyl and pentaerythritol esters, di(2-ethylhexyl)sebacate, di(2-ethylhexyl)adipate, dibutyl phthalate, fluorocarbons, silicate esters, silanes, esters of phosphorus-containing acids, liquid ureas, ferrocene derivatives, hydrogenated mineral oils, chain-type polyphenols, siloxanes and silicones (polysiloxanes), alkyl-substituted diphenyl ethers typified by a butyl-substituted bis-(p-phenoxy phenyl)ether, and phenoxyphenylether.

The organosulfur-containing copper salts in accordance with this invention can be effectively employed in any amount which is sufficient for imparting to the organic medium, e.g., lubricant, the desired degree of protection against oxidative degradation, etc. In many instances, the copper salt is employed in an amount from about 0.01 to about 5 wt.% and up to about 10% by weight, but preferably in an amount from about 0.1 to about 2%, by weight, of the organic composition. Other additives for their known purposes in amounts up to about 20 wt.% may be added to the compositions of the invention without reducing the effectiveness of the novel sulfurized fatty acid salts of the invention.

The following examples are merely exemplary and are meant in no way to limit the invention.

EXAMPLE 1

Part A: Approximately 282 gm (1.0 mole) of oleic acid and 8.0 gm (0.25 mole) of sulfur were charged to a reaction vessel. This mixture was heated up to 170° C. and held at 170°±2° C. under nitrogen blanket with agitation for two hours. The reaction temperature was gradually adjusted to 145° C. over two hours, and further down to 100° C. over another two hours under air purging. Upon cooling to ambient temperature overnight, the final product has a black color and contains 2.43% of sulfur (theory 2.76%).

Part B: Approximately 143 gm of the above product of Example 1, Part A, 27.6 gm (0.125 mole) of basic copper(II) carbonate (obtained commercially), and 150 ml toluene were reacted at 90°±10° C. for three hours. The volatiles (toluene and water etc.) were removed under reduced pressure using a rotary evaporator at the end of the reaction. This gave a greenish, viscous, semi-solid material containing 8.7% of copper (theory 9.47%).

EXAMPLE 2

Part A: Approximately 282 g of oleic acid and 32 g (1.0 mole) of sulfur were reacted as generally described in Example 1, Part A. This gave 312 g of dark liquid containing 9.3% of sulfur (theory 10.2%).

Part B: Approximately 156 g of the above product of Example 2, Part A, 27.6 g (0.125 mole) of basic copper(II) carbonate, and 150 ml toluene were reacted at 80°±10° C. for four hours. Then the volatiles were removed under reduced pressure using a rotary evaporator at the end of the reaction. The product has a deep green color and contains 9.4% of sulfur (theory 9.1%), 8.4% of copper (theory 9%).

EXAMPLE 3

Part A: Approximately 420.1 g (1.5 mole) of linoleic acid and 24 g (0.75) elemental sulfur were reacted as generally described in Example 1, Part A. This gave the sulfurized product as a viscous, black liquid containing 4.9% of sulfur (theory 5.4%), and having an acid number 190.9 (theory 191).

Part B: Approximately 147 g of the above product of Example 3, Part A, 27.6 g of basic copper(II) carbonate, and 150 ml toluene were reacted at 80°-110° C. for three hours. Then the volatiles were removed under reduced pressure using a rotary evaporator, leaving the product as a viscous, semi-solid material. The product has a deep green color and contains 4.66% of sulfur (theory 4.7%) and 9% copper (theory 9.3%).

The products of the examples were blended into fully formulated oils and evaluated by Catalytic Oxidation Test at 325° F. for forty hours (Table 1); Catalytic Oxidation Test at 260° F. for eighty hours (Table 2); and Catalytic Oxidation Test at 375° F. for twenty-four hours (Table 3). A comparison of the oxidation-inhibiting characteristics of the inventive products with the other traditional antioxidants in fully formulated oils is also included in Table 1.

The Catalytic Oxidation test may be summarized as follows.

The test lubricant composition is subjected to a stream of air which is bubbled through the composition at a rate of 5 liters per hour. Present in the composition are metals commonly used as materials of engine construction, namely:

(a) 15.6 sq. in. of sand-blasted iron wire,
(b) 0.78 sq. in. of polished copper wire,
(c) 0.87 sq. in. of polished aluminum wire, and
(d) 0.167 sq. in. of polished lead surface.

Inhibitors for oil are rated on the basis of prevention of oil deterioration as measured by the increase in acid formation or neutralization number (ΔNN) and kinematic viscosity (ΔKV) occasioned by the oxidation.

TABLE 1

| Antioxidant Evaluation 325° F. 40 Hrs. | | | | |
|---|---|---|---|---|
| Item | Additive Conc. (Wt. %) | KV at 100° C. (New Oil) | KV at 100° C. Used Oil | Percent Change in Viscosity KV |
| Base Oil (150 second, fully | — | 28.26 | 36.91 | 30.61 |

TABLE 1-continued

| Antioxidant Evaluation 325° F. 40 Hrs. | | | | |
|---|---|---|---|---|
| Item | Additive Conc. (Wt. %) | KV at 100° C. (New Oil) | KV at 100° C. Used Oil | Percent Change in Viscosity KV |
| formulated, solvent refined paraffinic bright oil containing defoamant/demulsifier/antiwear/anticorrosion/EP/antirust performance package) | | | | |
| Cupric Salt (Example 1) | 0.2 | 29.52 | 37.43 | 26.80 |
| Cupric Salt (Example 2) | 0.2 | 29.50 | 37.27 | 26.34 |
| 2,6-di-tert-butyl-p-cresol | 0.1 | 28.96 | 37.53 | 29.59 |
| | 0.5 | 28.53 | 37.76 | 32.35 |
| 2,6-di-tert-butylphenol | 0.1 | 28.75 | 37.76 | 31.34 |
| | 0.5 | 28.34 | 37.04 | 30.70 |
| Phenolic Antioxidant-Irganox L-130 | 0.5 | 28.64 | 36.42 | 27.16 |
| Arylamine Antioxidant-Irganox L-57 | 1.0 | 28.31 | 36.73 | 29.74 |
| Sulfur Antioxidant-DLTDP (Di-lauryl thiodipropionate) | 1.0 | 28.04 | 36.09 | 28.71 |

As little as 0.2% in a fully formulated mineral oil based gear oil of the products of Examples 1 and 2 controls the increase in viscosity of the test oil much better than equal or greater concentrations of more traditional antioxidants as shown in Table 1.

TABLE 2

| Antioxidant Evaluation 260° F. 80 Hrs. | | | | |
|---|---|---|---|---|
| Item | Additive Conc. (Wt. %) | KV at 100° C. (New Oil) | KV at 100° C. Used Oil | Percent Change in Viscosity ΔKV |
| Base Oil A (fully formulated mineral oil containing defoamant/demulsifier/antiwear/anticorrosion/EP, antirust performance package) | — | 28.26 | 30.09 | 6.48 |
| Base Oil A + Cupric Salt (Example 1) | 0.2 | 29.52 | 30.83 | 4.44 |
| Base Oil A + Cupric Salt (Example 2) | 0.2 | 29.50 | 30.97 | 4.98 |
| Base Oil A + Cupric Oleate | 0.2 | 29.73 | 31.34 | 5.42 |
| Base Oil B (fully formulated synthetic oil containing defoamant/demulsifier/antiwear/anticorrosion/EP, antirust performance package) | — | 59.32 | 62.35 | 5.11 |
| Base Oil B + Cupric Salt (Example 1) | 0.2 | 59.37 | 61.58 | 3.72 |

As shown above, these novel cupric antioxidants show remarkable activity in both mineral oil and synthetic oil formulations.

TABLE 3

| Antioxidant Evaluation 375° F. 24 Hrs. | | | | |
|---|---|---|---|---|
| Item | Additive Conc. (Wt. %) | KV at 100° C. (New Oil) | KV at 100° C. Used Oil | Percent Change in Viscosity KV |
| Base Oil (fully formulated mineral oil containing defoamant/demulsifier/antiwear/anticorrosion/EP, antirust performance package) | — | 29.06 | 80.74 | 177.8 |
| Cupric Salt (Example 1) | 0.2 | 29.52 | 61.21 | 107.4 |

TABLE 3-continued

| Antioxidant Evaluation 375° F. 24 Hrs. | | | | |
|---|---|---|---|---|
| Item | Additive Conc. (Wt. %) | KV at 100° C. (New Oil) | KV at 100° C. Used Oil | Percent Change in Viscosity KV |
| Cupric Salt (Example 2) | 0.2 | 29.50 | 61.27 | 107.7 |

The products of Examples 1 and 2 also show excellent control of oxidative stability in the fully formulated mineral oil based gear oil in high temperature applications as shown in Table 3.

The use of additive concentrations of sulfurized fatty acid copper salts in premium quality automotive and industrial lubricants significantly enhance their stability and extend their service life. The novel compositions described are useful at low concentrations and do not contain any potentially undesirable phosphorus or zinc. These multifunctional antioxidants can be readily made using an economically favorable process which could be readily implemented using known technology in existing equipment.

Although the present invention has been described with preferred embodiments, it is to be understood that modifications and variations may be resorted to, without departing from the spirit and scope of this invention, as those skilled in the art will readily understand. Such modifications and variations are considered to be within the purview and scope of the appended claims.

What is claimed is:

1. A composition comprising a major proportion of an oil of lubricating viscosity or grease or other solid lubricant prepared therefrom and a minor multifunctional amount, sufficient to impart antioxidant and/or anticorrosion, antiwear and EP properties thereto, of a mixture of sulfurized fatty acid copper salts containing at least one copper salt having the following generalized structure:

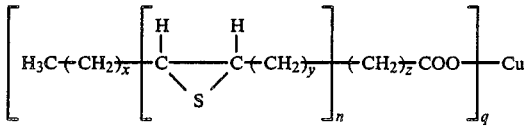

where x and z are from 0 to about 18, n is from 1 to about 4, y is from 0 to about 3 and q is 1 or 2.

2. The composition of claim 1 wherein said copper salts are Cu(I) salts.

3. The composition of claim 1 wherein said copper salts are Cu(II) salts.

4. The composition of claim 2 wherein the sulfurized fatty acid copper salt is prepared by reacting a sulfurized fatty acid in substantially molar, more than molar or less than molar quantities of Cu(I) ions.

5. The composition of claim 3 wherein the sulfurized fatty acid copper salt is prepared by reacting a sulfurized fatty acid in substantially molar, more than molar or less than molar quantities of Cu(II) ions.

6. The composition of claim 4 wherein the copper(I) ions are derived from cuprous hydroxide.

7. The composition of claim 5 wherein the copper II ions are derived from the group consisting of cupric acetate hydrate, basic cupric acetate, cupric carbonate, basic cupric carbonate and cupric hydroxide.

8. The composition of claim 7 wherein the cupric(II) ions are derived from basic cupric carbonate.

9. The composition of claim 8 wherein said sulfurized fatty acid copper salts are derived from said cupric carbonate and sulfurized oleic acid.

10. The composition of claim 8 wherein said sulfurized fatty acid copper salts are derived from cupric carbonate and sulfurized linoleic acid.

11. The composition of claim 1 wherein said oil of lubricating viscosity is a mineral oil.

12. The composition of claim 1 wherein said oil of lubricating viscosity is a synthetic oil.

13. The composition of claim 1 wherein said oil of lubricating viscosity is a mixture of mineral and synthetic oils.

14. A composition comprising a major proportion of an oil of lubricating viscosity or grease or other solid lubricant prepared therefrom and a minor multifunctional amount sufficient to impart antioxidant and/or anticorrosion, antiwear and EP properties thereto of a mixture of sulfurized fatty acid copper salts prepared by reacting (1) from about 0.10 to about 1 mole of elemental sulfur and/or $H_2S$ with about 0.10 to 1 mole or substantially molar quantities of $C_8$ to about $C_{30}$ unsaturated fatty acid and (2) thereafter reacting the product of (1) with more than, less than or substantially molar quantities of a Cu(I) or Cu(II) wherein (1) is carried out at gradually decreasing temperatures of from about 200° C. to about 90° C. and (2) is carried out at temperatures of from about 70° to about 150° C.

15. The composition of claim 14 having at least one copper salt having the following generalized structure:

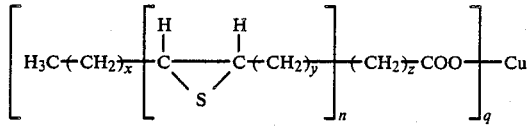

16. The composition of claim 14 wherein the copper(I) ions are derived from cuprous hydroxide.

17. The composition of claim 14 wherein the copper II ions are derived from the group consisting of cupric acetate hydrate, basic cupric acetate, cupric carbonate, basic cupric carbonate and cupric hydroxide.

18. The composition of claim 17 wherein the cupric(II) ions are derived from basic cupric carbonate.

19. The composition of claim 18 wherein said sulfurized fatty acid copper salts are derived from said cupric carbonate and sulfurized oleic acid.

20. The composition of claim 14 wherein said oil of lubricating viscosity is selected from mineral oils, synthetic oils and mixtures thereof.

21. The composition of claim 14 wherein said composition is a grease composition.

22. A multifunctional lubricant additive product prepared by reacting from about (1) 0.10 to about substantially molar quantities of elemental sulfur and/or $H_2S$ with 1 mole of $C_8$ to about $C_{30}$ unsaturated fatty acid and thereafter (2) reacting the resultant product with molar, less than molar or more than molar quantities of Cu(I) or Cu(II).

* * * * *